United States Patent [19]

Goto et al.

[11] Patent Number: 4,558,913

[45] Date of Patent: Dec. 17, 1985

[54] ELECTRICAL CONNECTOR

[75] Inventors: Moritaka Goto; Takahito Kameoka, both of Tokyo, Japan

[73] Assignee: Fujikura Ltd., Tokyo, Japan

[21] Appl. No.: 495,405

[22] Filed: May 17, 1983

[30] Foreign Application Priority Data

May 18, 1982 [JP] Japan ..... 57-83738
Dec. 23, 1982 [JP] Japan ..... 57-202190[U]

[51] Int. Cl.[4] ..... H01R 11/22
[52] U.S. Cl. ..... 339/74 R; 339/258 S; 339/256 SP
[58] Field of Search ..... 339/258 S, 258 F, 256 SP, 339/59 R, 59 M, 74 R

[56] References Cited

U.S. PATENT DOCUMENTS 2,682,040 6/1954 Batcheller ..... 339/258 S
3,644,872 2/1972 Russo, Jr. ..... 339/258 S
3,976,348 8/1976 Simmons ..... 339/258 S

FOREIGN PATENT DOCUMENTS 2719820 11/1977 Fed. Rep. of Germany ..... 339/256 SP
1353853 1/1964 France ..... 339/256 SP

*Primary Examiner*—Gil Weidenfeld
*Assistant Examiner*—Thomas M. Kline
*Attorney, Agent, or Firm*—Cushman, Darby & Cushman

[57] ABSTRACT

An electrical connector includes a female member and a male member. The elongated female member has a flat base portion and a pair of opposed retaining arms formed integrally on the base portion and extending along opposite lateral edges thereof to form a retaining portion of a generally channel-shaped cross-section. Each of the retaining arms has a side portion extending from the base portion and a distal end portion extending from the side portion. The side portions of the respective retaining arms are inclined inwardly toward each other. One end of the male member is adapted to be inserted into the retaining portion for being resiliently held by the retaining arms and the base portion to make an electrical connection between the female and male members.

4 Claims, 11 Drawing Figures

ELECTRICAL CONNECTOR

BACKGROUND OF THE INVENTION

1. Field of the Invention

This invention relates to an electrical connector for connecting wires, for example, in an electric wiring system of an automobile.

2. Prior Art

A conventional electrical connector 10 shown in FIG. 1 comprises a housing 11 of a synthetic resin, a female member 12 mounted within the housing 11, and a male member 13 secured at one end 13*a* to an electrical device 14 such as an induction coil by a screw 15. The female and male members 12 and 13 are made of an electrically-conductive metal plate.

The elongated female member 12 has a retaining portion 12*a* of a generally channel-shaped cross-section at one end thereof, the retaining portion having a pair of opposed retaining arms 12*b* and 12*b* of a generally C-shaped cross-section. A free end 13*b* of the male member 13 is adapted to be inserted into the retaining portion 12*a* with the free ends of the retaining arms 12*b* and 12*b* resiliently engaging the free end 13*b*, so that an electrical connection between the female and male members 12 and 13 is made. The female member 12 has a clamp portion 12*c* at the other end by which a wire is clamped.

When the wire 14 is subjected to a severe lateral pulling force after the female and male members 12 and 13 are connected together, relatively large stresses are applied to the retaining arms 12*b* and 12*b* so that the retaining arms may be subjected to damage. Even though the lateral pulling force is released before the retaining arms 12*b* and 12*b* are completely damaged, the retaining arms are subjected to a plastic deformation so that the electrical contact between the female and male members 12 and 13 may be adversely affected.

SUMMARY OF THE INVENTION

It is therefore an object of this invention to provide an electrical connector of the type in which a pair of retaining arms, when subjected to a severe lateral pulling force, are not subjected to deformation.

According to the present invention, there is provided an electrical connector which comprises a female member of an electrically-conductive metal plate including an elongated body having a flat base portion and a pair of opposed resiliently-deformable retaining arms formed integrally on the base portion at one end thereof and extending along opposite lateral edges thereof to form a retaining portion of a generally channel-shaped cross-section, each of the retaining arms having a side portion extending from the base portion and a distal end portion extending from the side portion, and the side portions of the respective retaining arms being inclined inwardly toward each other; and a male member of an electrically-conductive metal plate having a flat end portion adapted to be inserted into the retaining portion for being resiliently held by the retaining arms and the base portion to make an electrical connection between the female and male members.

DESCRIPTION OF THE PREFERRED EMBODIMENTS OF THE INVENTION

Figure 1:
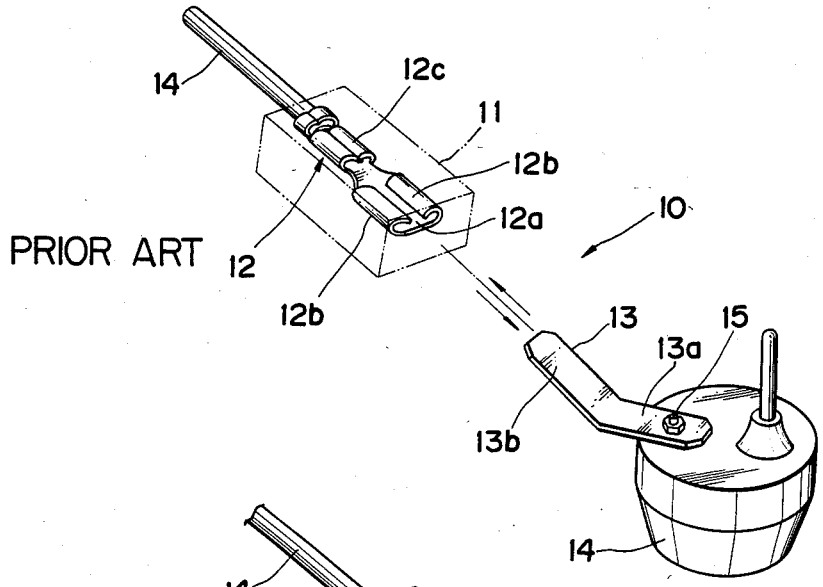
FIG. 1 is a perspective view of an electrical connector provided in accordance with the prior art.
Figure 2:
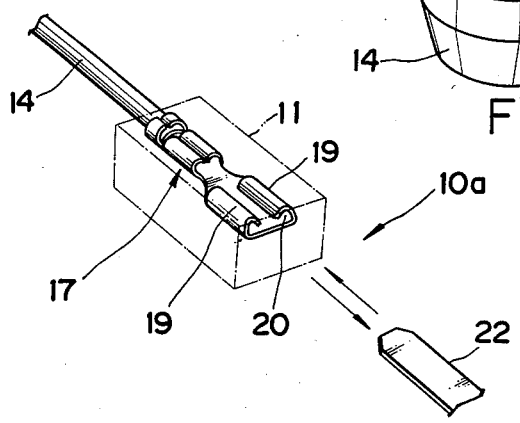
FIG. 2 is a perspective view of an electrical connector provided in accordance with the present invention.
Figure 3:
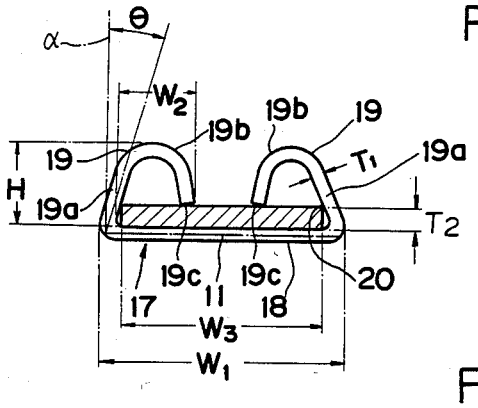
FIG. 3 is a cross-sectional view of a female member of the connector of FIG. 2.

FIG. 2 shows an electrical connector 10*a* which is substantially identical in construction to the electrical connector 10 of FIG. 1 except for the configuration of the retaining arms 12*b* and 12*b* of the female member 12, as will hereinafter more fully be described. A female member 17 mounted within a housing 11 is made of an electrically-conductive metal plate and comprises an elongated body which includes a flat base portion 18 and a pair of opposed retaining arms 19 and 19 formed on the base portion 18 at one end thereof and extending along opposite lateral edges thereof to form a retaining portion 20 of a generally channel-shaped cross-section. As best shown in FIG. 3, each of the retaining arms 19 and 19 has a substantially straight side portion 19*a* extending from the base portion 18, and a curved distal end portion 19*b* extending from the straight portion 19*a*, the free end 19*c* of the retaining arm 19 being directed toward the base portion 18 and spaced therefrom a distance slightly smaller than the thickness of a male member 22.

According to an important aspect of the present invention, the straight side portions 19*a* and 19*a* of the two retaining arms 19 and 19 are inclined inwardly toward each other at a predetermined angle $\theta$ relative to a plane $\alpha$ perpendicular to the base portion 18. The angle $\theta$ is, for example, 10 degrees. Due to the inclination of the straight side portions 19*a* and 19*a*, the strength of each retaining arm 19 is substantially increased so that it can withstand severe lateral outward pulling forces.

As described above, in the case where angle $\theta$ is 10 degrees, the female member 17 has the following dimensions:

Thickness $T_1$: 0.4 mm

Width $W_1$ of the base portion: 7.5 mm

Width $W_2$ of the retaining arm: 2.75 mm

Height H of the retaining arm: 3 mm.

Also, the female member 17 is made of brass (JISC 2600RH), and the male member 22 has a thickness ($T_2$) of 0.8 mm and a width ($W_3$) of 6.4 mm. In the normal state, that is to say, when the male member 22 is not inserted in the retaining portion 20, the free end 19*c* of each retaining arm 19 is spaced from the base portion 18 a distance of 0.6 mm. Therefore, the amount of resilient deformation of each retaining arm 19 in the direction away from the base portion 18 is 0.2 mm when the male member 22 is inserted into the retaining portion 20.

It will be appreciated that the angle $\theta$ will vary with the dimensions of the female and male members 17 and 22.

The male member 22 is adapted to be received in the retaining portion 20 of the female member 17 with the free ends 19c and 19c of the two retaining arms 19 and 19 resiliently engaging the upper surface of the male member 22, so that the male member is held against movement relative to the female member. In this condition, when severe lateral outward pulling forces in any direction is applied to the wire 14, the retaining arms 19 and 19 will not be bent or deformed outwardly since the retaining arms 19 and 19 have an increased strength because of the provision of the inclined straight side portions 19a and 19a.

Thus, even if the retaining arms 19 and 19 are subjected to severe lateral outward pulling forces in any direction, the electrical connection between the female and male members 17 and 22 will not be affected.

Figure 4:
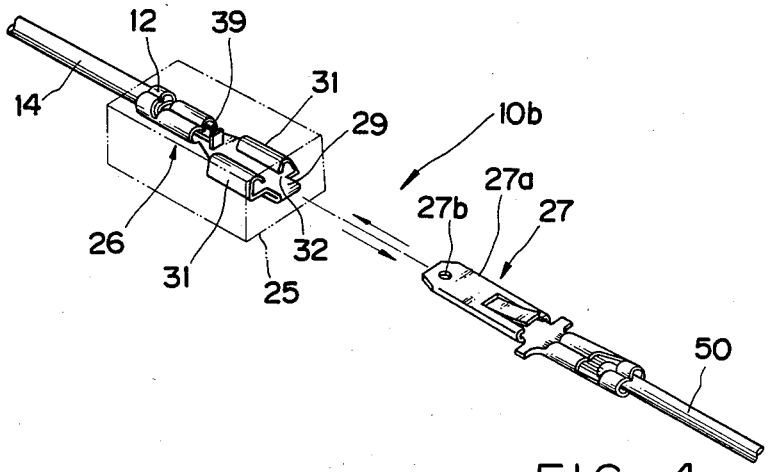
FIG. 4 is a view similar to FIG. 2 but showing a modified electrical connector.
Figure 5:
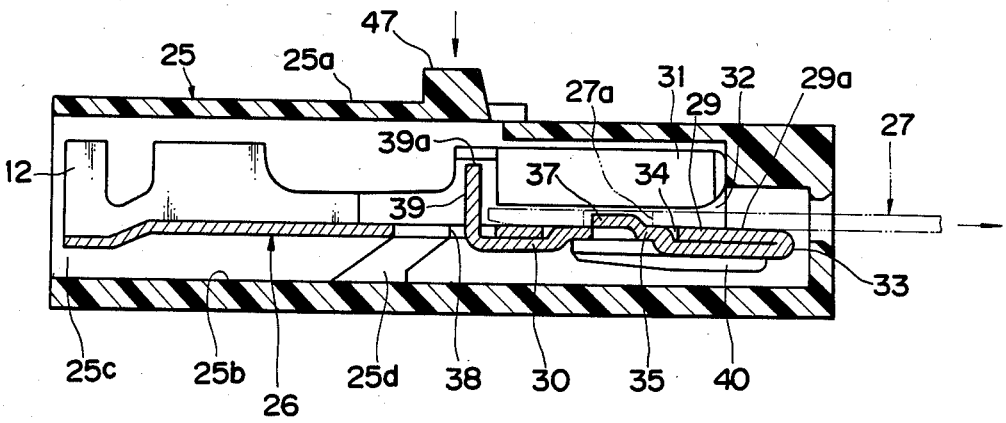
FIG. 5 is a cross-sectional view of a female member of the connector of FIG. 4 mounted within a housing.
Figure 6:
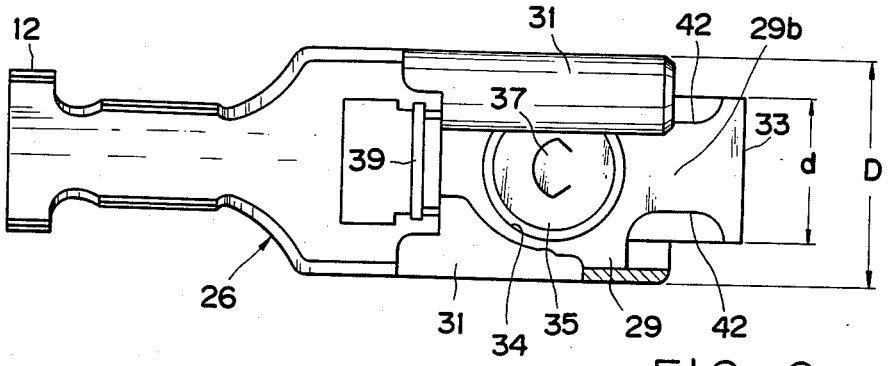
FIG. 6 is a plan view of the female member of FIG. 5.

FIG. 4 shows a modified electrical connector 10b which comprises a housing 25 of a synthetic resin, a female member 26 mounted within the housing 25, and a male member 27. As best shown in FIG. 5, the female member 26 is made of an electrically-conductive metal plate and includes an elongated body having a flat base portion 29 which is reversely folded over on itself at one end thereof to form a folded portion 30. A pair of opposed retaining arms 31 and 31 are formed on that portion of the base portion 29 disposed in contiguous relation to the folded portion 30 and extend along the opposite lateral edges thereof to form a retaining portion 32 of a generally channel-shaped cross-section, the pair of retaining arms 31 and 31 being disposed adjacent to a folded tip end 33 of the female member 26. A forward end 29a of the base portion 29 and the folded portion 30 have a width d less than a width D of the major portion of the female member 26, as shown in FIG. 6.

A circular aperture 34 is formed through the base portion 29 at the retaining portion 32, the circular aperture 34 being disposed centrally of the width of the base portion 29. The folded portion 30 has a raised or stepped section 35 of a circular shape which is drawn out of the plane of the folded portion 30 toward the retaining portion 32. The raised section 35 is received in the circular aperture 34, and the upper surface of the raised section 35 lies flush with the upper surface of the base portion 29. The raised section 35 has a stamped-out lock tongue 37 of a generally sector-shape formed at its center and offset therefrom in a direction away from the folded portion 30. The raised section 35 serves to disperse bending stresses acting on the lock tongue 37 to prevent it from damage or breakage. Also, the provision of the raised section 35 serves to reduce the amount of offset of the lock tongue 37 so that the strength of the lock tongue 37 is not unduly reduced.

An aperture 38 is formed through the base portion 29 and disposed rearwardly of the aperture 34. The free end of the folded portion 30 is bent upwardly right-angularly to provide a lug 39 which extends through the aperture 38.

Figure 7:
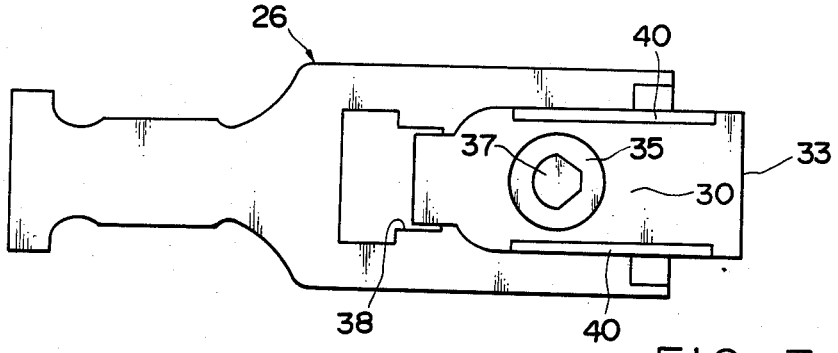
FIG. 7 is a bottom view of the female member of FIG. 5.

As best shown in FIG. 7, a pair of opposed longitudinal reinforcing ribs 40 and 40 are formed on opposite lateral edges of the folded portion 30 at one surface thereof facing away from the base portion 29, the reinforcing ribs being disposed perpendicular to the folded portion 30 and disposed adjacent to the folded tip end 33. The reinforcing ribs 40 and 40 extend rearwardly to the rear end of the raised section 35. By virture of the provision of the reinforcing ribs 40 and 40, the strength of the folded portion 30 is increased.

Figure 8:
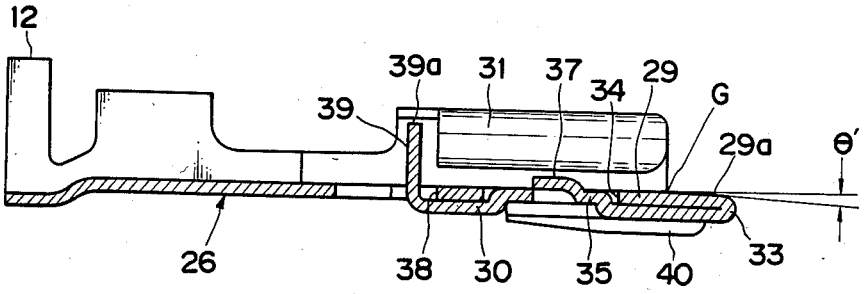
FIG. 8 is a cross-sectional view of the female member of FIG. 5.

The forward end 29a of the base portion 29 is cut away at the opposite lateral edges to provide a pair of generally U-shaped notches 42 and 42, as shown in FIG. 6. As shown in FIG. 8, the forward end 29a of the base portion 29 is slightly bent at a position indicated by G so that the forward end 29a is inclined downwardly at an angle $\theta'$ (for example, 2 to 3 degrees) relative to the remainder of the base portion 29. The forward end 29a of the base portion 29 can be resiliently deformed slightly because of the provision of the notches 42 and 42.

The female member 26 also has at its rear end a clamp portion 12 by which a wire 14 is firmly clamped.

Figure 9:
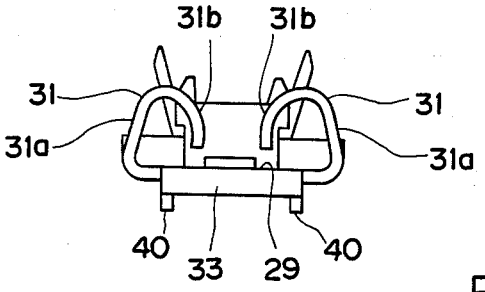
FIG. 9 is a front end view of the female member of FIG. 5.
Figure 10:
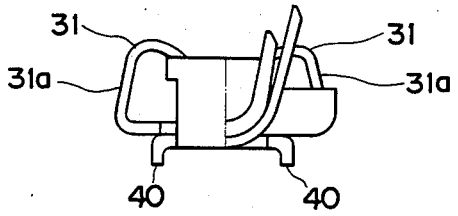
FIG. 10 is a rear end view of the female member of FIG. 5.

The retaining arms 31 and 31 are identical in construction to the retaining arms 19 and 19 of the female member 17 shown in FIGS. 2 and 3. As shown in FIGS. 9 and 10, each of the retaining arms 31 and 31 has a substantially straight side portion 31a extending from the base portion 29, and a curve distal end portion 31b extending from the straight side portion 31a. The straight side portions 31a and 31a of the two retaining arms 31 and 31 are inclined inwardly toward each other at a predetermined angle relative to a plane perpendicular to the base portion 29. Thus, the retaining arms 31 and 31 can withstand severe lateral outward pulling forces, as described above for the female member 17 shown in FIGS. 2 and 3.

Figure 11:
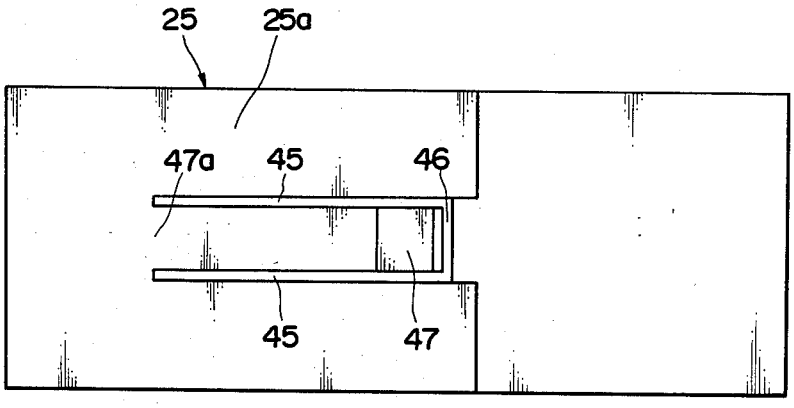
FIG. 11 is a plan view of the housing.

The connector housing 25 of a hollow construction has a rectangular shape having a top wall 25a, a bottom wall 25b and opposite side walls 25c. The female member 26 is accommodated within the housing 25 and is supported by a support portion 25d formed on the bottom wall 25b. As shown in FIG. 11, a pair of parallel slits 45 and 45 are formed longitudinally through the top wall 25a of the housing 25 and cooperate with an opening 46 to form a manipulating piece 47 which is resiliently deformable for angular movement about its proximal end 47a toward the bottom wall 25b.

The male member 27 of an electrically-conductive metal plate comprises an elongated body having a flat portion 27a at one end thereof. A wire 50 is secured to the other end thereof. A retaining aperture 27b is formed through the flat portion 27a.

When the female and male members 26 and 27 are to be connected together, the flat portion 27a of the male member 27 is inserted into the the retaining portion 32 of the female member 26 so that the lock tongue 37 is fitted in the retaining aperture 27b, with the flat portion 27a resiliently held by the free ends 31c and 31c of the retaining arms 31 and 31 and the upper surface of the base portion 29. Since the forward end 29a of the base portion 29 is inclined downwardly by the predetermined angle $\theta'$, the flat portion 27a of the male member 27 can be easily introduced into the retaining portion 32 without making contact with the forward end 29a.

When the female member 26 is subjected to a severe longitudinal pulling force in a direction away from the male member 27, such pulling force tends to cause the folded portion 30 to buckle or be deformed through the lock tongue 37. Actually, however, since the folded portion 30 is provided with the pair of reinforcing ribs 40 and 40, it is not subjected to buckling or deformation. At this time, although the lock tongue 37 received in the retaining aperture 27b is also subjected to a bending force or stress, such bending force is suitably absorbed due to the resilient nature of both of the lock tongue 37 and raised section 35.

In the case where the above-mentioned longitudinal pulling force is excessive, the lock tongue 35 is broken off from the female member 26. Thereafter, the female member 26 with no lock tongue can still be used as one having no locking means.

When it is desired to disconnect the male member 27 from the female member 26, the manipulating piece 47 is depressed downwardly (FIG. 5) into contact with the free end 39a of the lug 39 so that the folded portion 30 is slightly angularly moved to disengage the lock tongue 37 from the retaining aperture 27b. Under this condition, the male member 27 is withdrawn from the female member 26 to interrupt the electrical connection therebetween. When the lug 39 is urged downwardly by the manipulating piece 47, that portion 29b of the base portion 29 (FIG. 6) lying between the pair of notches 42 and 42 is resiliently deformed to allow the slight angular movement of the folded portion 30. At this time, the folded forward end portion of the female member 26 formed by the base portion 29 and the folded portion 30 disposed in contiguous relation thereto is raised slightly upwardly and will not be opened. Since the forward end 29a of the base portion 29 is inclinded slightly downwardly (FIG. 8) at an angle $\theta'$, the lower surface of the flat portion 27a of the male member 27 will not be brought into contact with the forward end 29a when the folded forward end portion of the female member 26 is raised slightly upwardly during the withdrawal of the male member 27 from the female member 26.

What is claimed is:

1. An electrical connector comprising:

(a) a female member of an electrically-conductive metal plate including an elongated body having a flat base portion and a pair of opposed resiliently deformable retaining arms formed integrally on said base portion and extending along opposite lateral edges thereof to form a retaining portion of a generally channel-shaped cross-section, each of said retaining arms having a side portion extending from said base portion and a distal end portion extending from said side portion, and said side portions of the respective retaining arms being inclined inwardly toward each other; and (b) a male member of an electrically-conductive metal plate having a flat end portion adapted to be inserted into said retaining portion for being resiliently held by said retaining arms and said base portion to make an electrical connection between said female and male members, said base portion being reversely folded over on itself at one end thereof to form a folded portion, said base portion having a first aperture formed therethrough and disposed at said retaining portion, said foled portion having a lock tongue received in said first aperture and extending into said retaining portion, said male member having a retaining aperture formed through said flat end portion thereof so that upon insertion of said flat end portion into said retaining portion, said lock tongue is fitted in said retaining aperture to retain said male member against movement relative to said female member, and said folded portion having a pair of longitudinal reinforcing ribs formed on opposite lateral edges thereof at one surface facing away from said base portion, said base portion having a second aperture formed therethrough and disposed adjacent to said folded portion, said base portion being reduced in width at its forward end disposed in contiguous relation to said folded portion so as to be resiliently deformable and said folded portion having its free end directed upwardly toward said retaining portion to form a lug which is received in said second aperture whereby, upon depression of said lug, said base portion is resiliently deformed at its reduced section to move said lock tongue in a direction away from said retaining portion.

2. An electrical connector according to claim 1, in which the formed end of said base portion is inclined in a direction away from said retaining portion.

3. An electrical connector according to claim 1, further comprising a hollow housing within which said female member is mounted, said housing having manipulating piece engageable with said lug to depress the same.

4. An electrical connector according to claim 1, in which said folded portion has a raised section offset therefrom towards said retaining portion and which fits in said first aperture, the upper surface of said raised section lying substantially flush with the upper surface of said base portion, and said lock tongue being formed on said raised section.

* * * * *